US005971184A

United States Patent [19]

Krishnakumar et al.

[11] Patent Number: 5,971,184

[45] Date of Patent: Oct. 26, 1999

[54] HOT-FILLABLE PLASTIC CONTAINER WITH GRIPPABLE BODY

[75] Inventors: Suppayan M. Krishnakumar, Nashua; Wayne N. Collette, Merrimack; David Piccioli, Auburn, all of N.H.

[73] Assignee: Continental PET Technologies, Inc., Florence, Ky.

[21] Appl. No.: 08/959,423

[22] Filed: Oct. 28, 1997

[51] Int. Cl.[6] ..... B65D 23/00; B65D 23/10

[52] U.S. Cl. ..... 215/384; 215/379; 215/382; 220/608; 220/675; 220/771

[58] Field of Search ..... 215/382–384, 215/379; 220/608, 675, 771

[56] References Cited

U.S. PATENT DOCUMENTS

| | | | |
|---|---|---|---|
| D. 192,536 | 4/1962 | Laudano | D58/5 |
| D. 193,216 | 7/1962 | Laudano | D58/25 |
| D. 193,312 | 7/1962 | Buckley | D58/25 |
| D. 196,990 | 11/1963 | Dubbs | D58/25 |
| D. 198,404 | 6/1964 | Busch | D58/5 |
| D. 202,002 | 8/1965 | Douglas | D9/7 |
| D. 208,504 | 9/1967 | Trombley | D58/8 |
| D. 213,421 | 3/1969 | Leary | D9/101 |
| D. 214,550 | 7/1969 | Plummer | D9/44 |
| D. 272,321 | 1/1984 | Kretz | D9/1 |
| D. 275,556 | 9/1984 | Thomson | D9/389 |
| D. 278,977 | 5/1985 | Franchi et al. | D9/383 |
| D. 279,167 | 6/1985 | Haney et al. | D9/367 |
| D. 281,577 | 12/1985 | Larson et al. | D9/372 |
| D. 294,118 | 2/1988 | Papa | D9/390 |
| D. 294,463 | 3/1988 | Lang | D9/392 |
| D. 305,980 | 2/1990 | Binder et al. | D9/372 |
| D. 308,482 | 6/1990 | Wild | D9/401 |
| D. 315,869 | 4/1991 | Collette | D9/392 |
| D. 318,798 | 8/1991 | Biesecker | D9/378 |
| D. 323,983 | 2/1992 | Bastidos | D9/378 |
| D. 329,817 | 9/1992 | Best | D9/556 |
| D. 344,457 | 2/1994 | Prevot et al. | D9/537 |
| D. 345,693 | 4/1994 | Edstrom | D9/332 |
| D. 352,245 | 11/1994 | Krishnakumar et al. | D9/538 |
| 2,893,678 | 7/1959 | Homan et al. | 215/384 X |
| 3,185,353 | 5/1965 | Mercier | 222/206 |
| 3,536,500 | 10/1970 | Cleereman et al. | 99/171 |
| 3,537,498 | 11/1970 | Amand | 215/384 |
| 4,610,366 | 9/1986 | Estes et al. | 215/1 C |
| 4,749,092 | 6/1988 | Sugiura et al. | 215/1 C |
| 4,804,097 | 2/1989 | Alberghini et al. | 215/100 A |
| 4,805,788 | 2/1989 | Akiho | 215/1 C |
| 4,818,575 | 4/1989 | Hirata et al. | 428/36.7 |
| 4,863,046 | 9/1989 | Collette et al. | 215/1 C |
| 4,877,141 | 10/1989 | Hayashi et al. | 215/1 C |
| 4,890,752 | 1/1990 | Ota et al. | 215/1 |
| 4,907,709 | 3/1990 | Abe et al. | 215/252 |
| 4,993,565 | 2/1991 | Ota et al. | 215/1 |
| 5,054,632 | 10/1991 | Alberghini et al. | 215/1 C |
| 5,064,081 | 11/1991 | Hayashi et al. | 215/1 C |
| 5,067,622 | 11/1991 | Garver et al. | 215/1 C |
| 5,092,475 | 3/1992 | Krishnakumar et al. | 215/1 C |
| 5,141,120 | 8/1992 | Brown et al. | 215/1 |
| 5,141,121 | 8/1992 | Brown et al. | 215/100 A |
| 5,178,289 | 1/1993 | Krishnakumar et al. | 215/1 C |
| 5,199,587 | 4/1993 | Ota et al. | 215/384 X |
| 5,226,550 | 7/1993 | Mikolaitis et al. | 215/384 |
| 5,238,129 | 8/1993 | Ota | 215/1 C |
| 5,255,889 | 10/1993 | Collette et al. | 249/102 |
| 5,279,433 | 1/1994 | Krishnakumar et al. | 215/1 C |
| 5,303,833 | 4/1994 | Hayashi et al. | 215/1 C |
| 5,303,834 | 4/1994 | Krishnakumar et al. | 215/1 C |
| 5,337,909 | 8/1994 | Vailliencourt | 215/1 C |
| 5,341,946 | 8/1994 | Vailliencourt et al. | 215/1 C |
| 5,392,937 | 2/1995 | Prevot et al. | 215/1 C |
| 5,472,105 | 12/1995 | Krishnakumar et al. | 215/384 |
| 5,598,941 | 2/1997 | Semersky et al. | 215/384 |
| 5,758,790 | 6/1998 | Ewing, Jr. | 215/384 |
| 5,762,221 | 6/1998 | Tobias et al. | 215/382 X |

FOREIGN PATENT DOCUMENTS

| | | |
|---|---|---|
| 0198587 A2 | 10/1986 | European Pat. Off. . |
| 0 423 406A1 | 4/1991 | European Pat. Off. . |
| 0446352 A1 | 9/1991 | European Pat. Off. . |
| 0505054 A1 | 9/1992 | European Pat. Off. . |

OTHER PUBLICATIONS

Australian Design Application 3503/93 filed Nov. 5, 1993.
Australian Design Application 3629/93 filed Nov. 17, 1993.
Australian Design Application 1475/94 filed May 12, 1994.
Schweppes Sport Plus Bottle (Jul. 1994).
Mott's® Apple Juice Product Specification (Mar. 1992).
Photos of a glass Mott's Apple Juice Bottle.

Photos of a Tropicana Twister Light Bottle.
Photos of a Poconos Springs Water Bottle.

*Primary Examiner*—Sue A. Weaver
*Attorney, Agent, or Firm*—Wolf, Greenfield & Sacks, P.C.

[57] ABSTRACT

A hot-fillable plastic container having a panel section of a size suitable for gripping the container in one hand. The panel section includes two opposing vertically-elongated and radially-indented vacuum panels, and two opposing horizontally-disposed and radially-indented finger grips. Each vacuum panel preferably has an invertible central wall portion movable from a convex first position prior to hot-filling of the container, to a concave second position under vacuum pressure following hot-filling and sealing of the container.

14 Claims, 7 Drawing Sheets

HOT-FILLABLE PLASTIC CONTAINER WITH GRIPPABLE BODY

FIELD OF THE INVENTION

The present invention relates to a hot-fillable plastic container having a panel section suitable for gripping the container in one hand.

BACKGROUND OF THE INVENTION

The packaging of certain liquids requires that they be placed in a container while hot to provide for adequate sterilization. Hot-filled containers are designed for this purpose. During filling, the container is subjected to elevated temperatures on the order of 82° C. (the product temperature) or higher. The container is then capped and as the product cools, a negative internal pressure is formed in the sealed container.

Biaxially-oriented polyethylene terephthalate (PET) beverage bottles have been designed to receive a hot-fill product with a minimum of thermal shrinkage and distortion. One such bottle is described in U.S. Pat. No. 4,863,046 entitled "Hot Fill Container," which issued Sep. 5, 1989 to Collette et al. The Collette et al. container has six recessed vacuum panels in the middle panel section of the container. The panels reduce the magnitude of the vacuum generated in the filled and capped container to prevent any large uncontrolled shape distortion. As the product cools, the vacuum panels (all of them) deform and move inwardly in unison. A wrap-around label covers the vacuum panels and is supported by raised central wall portions in the vacuum panels, post areas between the vacuum panels, and horizontal glue land areas above and below the vacuum panels. Longitudinal (vertical) recessed ribs may be provided in the post areas and raised wall portions in the vacuum panels to increase the longitudinal stiffness of the panel section.

The design of the vacuum panels may vary; other designs are illustrated in: 1) U.S. Design Pat. No. 315,869, "Container Body for Liquids Or The Like," Apr. 2, 1991 to Collette; 2) U.S. Pat. No. 5,255,889, "Modular Mold," Oct. 26, 1993 to Collette et al; 3) U.S. Pat. No. 5,178,289, "Panel Design For A Hot-Fillable Container," Jan. 12, 1993 to Krishnakumar et al.; and 4) U.S. Pat. No. 5,303,834, "Squeezable Container Resistant To Denting," Apr. 19, 1994 to Krishnakumar et al.

Providing a container with a gripping portion to facilitate handling has become increasingly popular in recent years. Generally, it is not sufficient to simply add a gripping portion to the container; rather, the container design and/or wall thickness needs to be modified to strengthen the container walls and control the amount of deformation which occurs when the container is grasped. Increasing the container wall thickness is undesirable as this leads to a substantial increase in the amount of material and thus cost of the container. These increased costs are unacceptable in the extremely competitive container industry. Thus, as the demand for grippable bottles has continued to grow, especially in the soft-drink and sports-drink industries, new and improved designs that retain their shape when firmly grasped are required.

SUMMARY OF THE INVENTION

The present invention is directed to a hot-fillable plastic container having a grippable panel section.

In a first embodiment, the panel section includes a panel wall having two vertically-elongated and radially-indented vacuum panels, and two sets of horizontally-disposed and radially-indented finger grip portions. Each vacuum panel has an invertible central wall portion movable from a convex first position prior to hot-filling of the container, to a concave second position under vacuum pressure following hot-filling and sealing of the container. Preferably a pair of vertically-elongated and radially-indented ribs are provided in the panel wall, adjacent either side of each vacuum panel, which act as hinge points to facilitate movement of the central wall portions. The inversion of the central wall portion from a convex to a concave configuration increases the amount of vacuum panel movement and thus alleviates sufficient vacuum pressure to enable the use of only two vacuum panels in the container. The hinge points further increase movement of the central wall portion to alleviate the vacuum in a container having only two vacuum panels.

The panel wall diameter is selected to enable gripping in one hand. For example, a preferred range of panel diameter is 60–120 mm (roughly 2.5–4.5 inches). The two opposing sets of finger grips, between the vacuum panels, enable the container to be readily grasped in one hand during use. The finger grips are a plurality of indented channels, each channel being configured to receive a finger or thumb of the user. The finger grip channels also provide resistance to bending of the panel in the hoop direction. The vertical ribs, disposed adjacent either side of the vacuum panels, isolate the vacuum panel movements from the finger grips. The vertical ribs also resist the longitudinal bending of the panel section.

By providing alternating vacuum panels and finger grip portions about the circumference of the panel wall, there is effectively provided two alternative mechanisms for gripping the container. The first is the two sets of finger grips. The second alternative is the two vacuum panels, which have a concave central wall portion that enables gripping between the fingers and thumb of one hand. Providing two options for gripping is particularly desirable and convenient for the user. The concave vacuum panels generally provide a smaller span (width) than the finger grips, thus providing ease of gripping for two users with different sized hands.

These and other features and benefits of the present invention will be more particularly understood with regard to the following detailed description and drawings.

DETAILED DESCRIPTION

Figure 1:
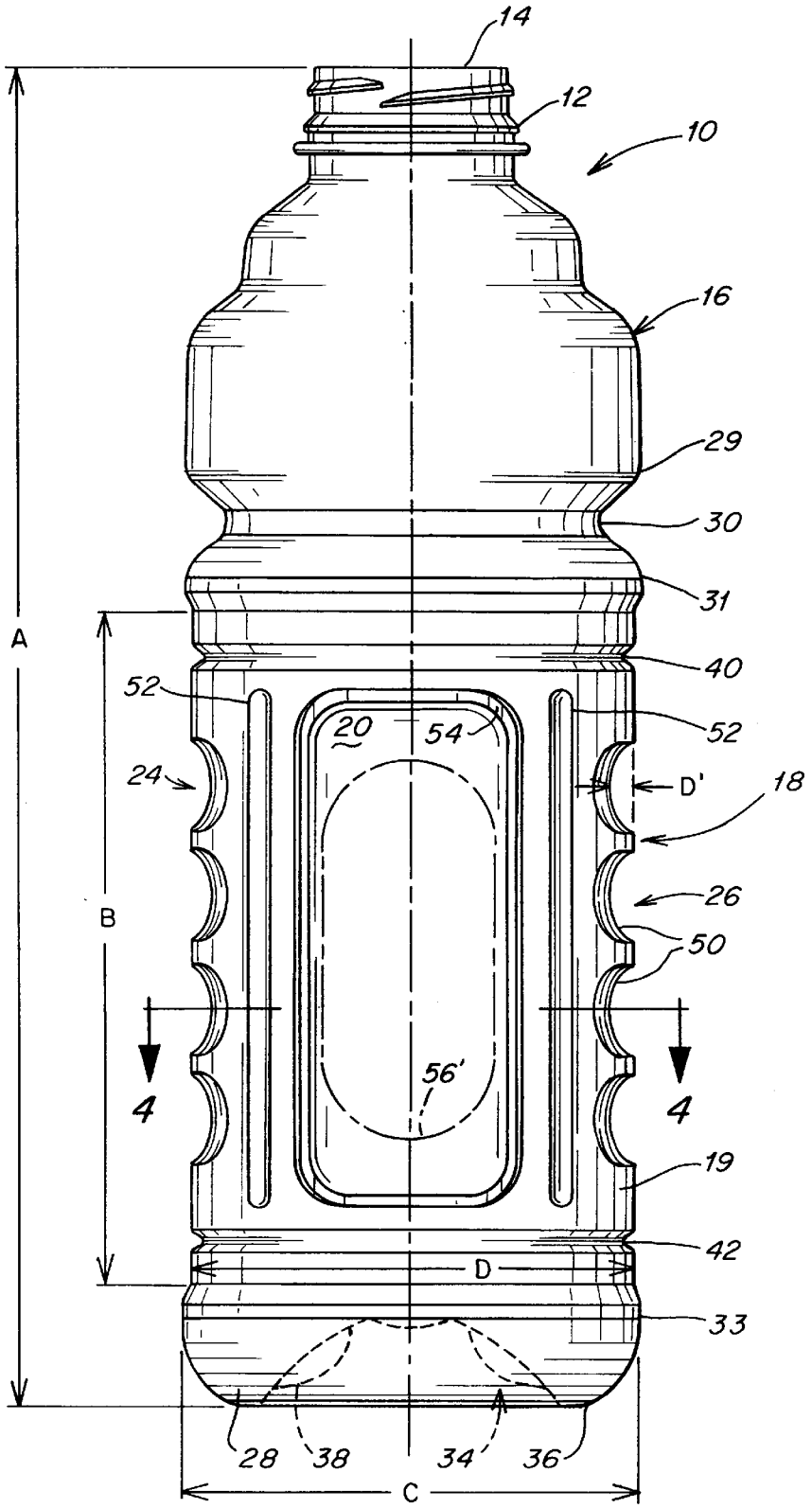
FIG. 1 is a front elevational view of a first embodiment of a hot-fillable container of this invention, showing one of two opposing vertically-disposed vacuum panels and a pair of vertical ribs adjacent either side of the vacuum panel.
Figure 2:
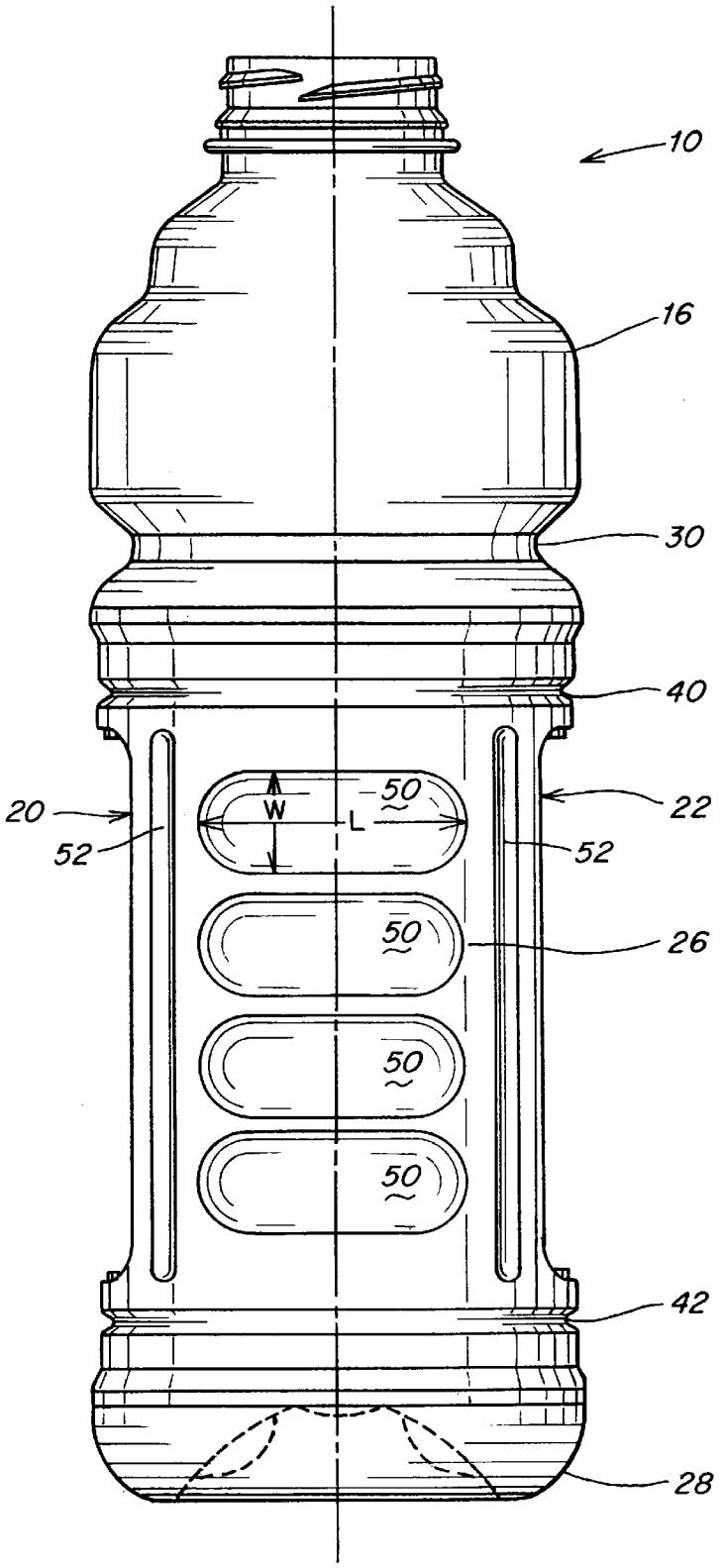
FIG. 2 is a side elevational view of the container of FIG. 1, showing one of two opposing finger grip portions.
Figure 3:
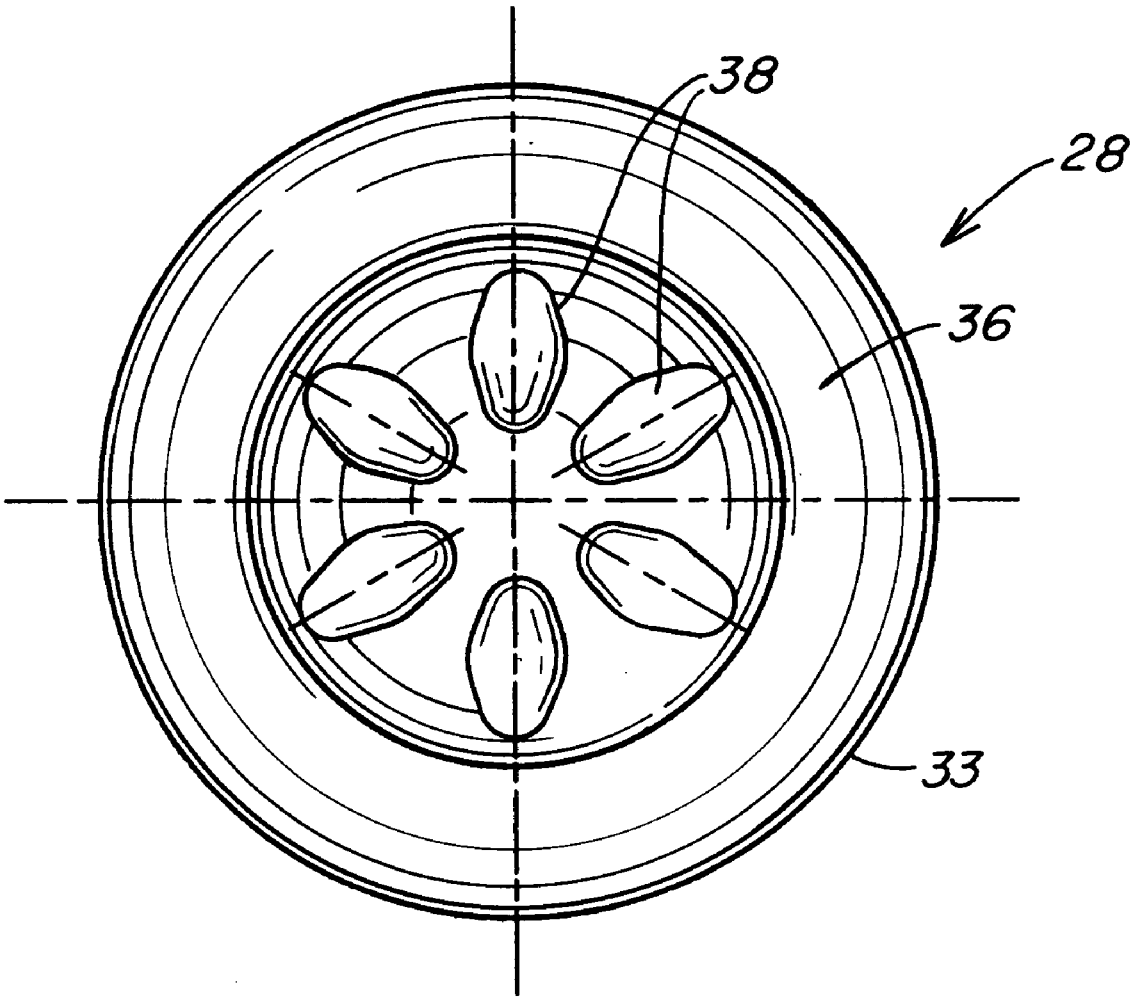
FIG. 3 is a bottom plan view of the base of the container.

FIG. 1 shows a particular embodiment of the present invention—a 1.2 liter (40 oz) polyethylene terephthalate (PET) hot-fillable beverage bottle. The bottle 10 has an overall height A of about 206 mm, a panel section height B of about 125 mm, and an overall diameter C of about 92 mm. The thickness of the container at the panel section B is on the order of 0.4 mm.

The bottle is blow-molded from an injection molded preform (not shown), having an upper threaded neck finish and a lower tube portion. During blowing, the preform is expanded and assumes the shape of an interior molding surface (not shown) to form a substantially transparent, biaxially-oriented bottle. The neck finish is not expanded and remains as the neck finish 12 of the bottle with an open mouth 14 for receiving a screw-on cap (not shown). The lower preform tube portion is expanded to form: (a) a shoulder section 16 increasing generally in diameter from the neck finish 12 to a substantially cylindrical panel section 18; (b) the panel section 18 including a pair of front and back vertically-elongated vacuum panels 20, 22, and right and left sets of horizontally-disposed finger grips 24, 26; and (c) a base 28.

A lower shoulder portion includes a radially-recessed hoop rib 30 between enlarged diameter portions 29, 31. The hoop rib 30 helps prevent ovalization of the container (nonsymmetrical radial deformation caused by the negative pressure generated in the container during cooling of the hot-filled product). The enlarged portion 31 forms an upper bumper, just above the panel section 18. The base 28 includes an enlarged diameter lower bumper 33, and a central recessed dome portion 34 surrounded by a standing ring or chime 36. As is well-known in the base design of hot-fillable containers, the dome includes biaxially-oriented elements 38 such that the dome moves inwardly to reduce the negative pressure generated during product cooling.

The panel section of height B extends between the upper and lower bumpers 31, 33 respectively. The upper and lower bumpers are of greater diameter than the panel wall 19. The substantially cylindrical panel wall 19, having a diameter D of 88 mm, includes upper and lower radially-indented hoop ribs 40, 42 disposed above and below the vacuum panels and finger grips. These hoop ribs in the panel section are intended to prevent buckling of the panel section, when the vacuum panels move to alleviate the negative pressure.

Figure 4:
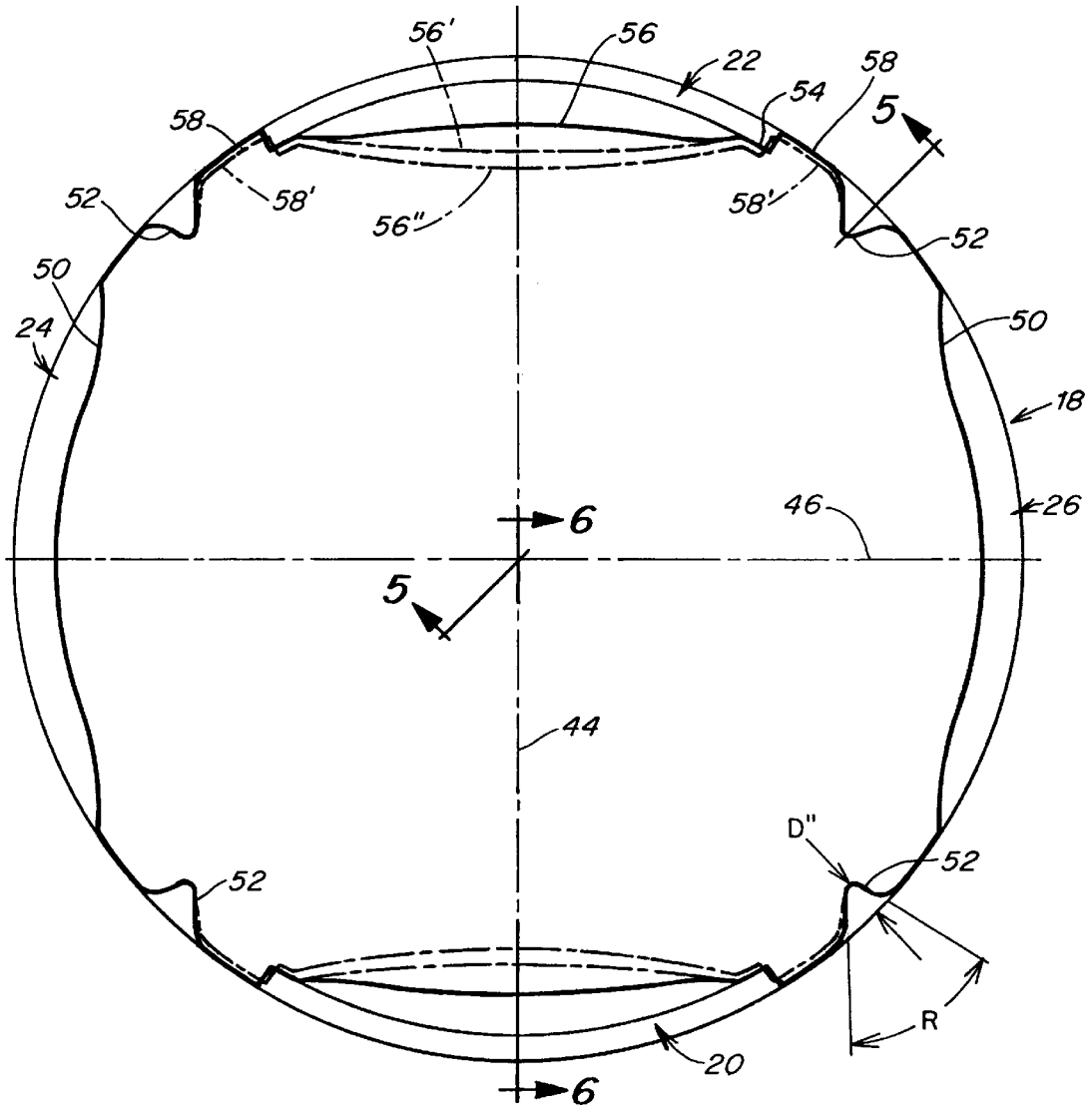
FIG. 4 is an enlarged cross-sectional view of the panel section of the container of FIG. 1, taken along section line 4—4, showing the various positions of the vacuum panel as manufactured (solid lines) and the inward movement (following hot-filling and capping) to alleviate the negative pressure generated in the container (dashed lines).

As shown in horizontal cross-section in FIG. 4, the substantially cylindrical panel wall 19 includes the two opposing radially-recessed vacuum panels 20, 22 symmetrically disposed both with respect to a first vertical plane 44 and a second transverse vertical plane 46. This is desirable to provide symmetrical vacuum panel movement, and is particularly useful for smaller diameter containers, i.e., on the order of 4.5 inches (120 mm) and smaller in diameter. Each vacuum panel is disposed between left and right sets of grip portions 24, 26. The grip portions each include four parallel, vertically-disposed, and radially-indented channels 50, each channel being horizontally-disposed and of a width adapted to receive a finger or thumb of the user. In this example, the width W of the channel is 18 mm, the length L of the channel is 48 mm, and the depth D' of the channel is 4 mm. The vertical distance between channels is 23 mm.

As shown in FIG. 4, a pair of vertical ribs are disposed adjacent the vertical side edges of each vacuum panel. These four vertical ribs 52 are symmetrically disposed about the circumference of the panel section. Each rib has a radial extent R of about 60°, and a depth D" of about 3.8 mm.

Each vacuum panel 20, 22 includes a radially-recessed shoulder portion 54, forming a continuous boundary with the panel section 18. Inside the shoulder portion is a central invertible wall portion 56. The wall portion 56 as molded is convex (as viewed from the exterior of the container); this position is shown in solid lines in FIG. 4. Once the container is hot-filled and capped, the product begins to cool and generates a negative pressure inside the container. This causes the convex central wall portion to move radially inwardly, and adopt a first concave position 56' (as viewed from the outside of the container), shown in dashed lines in FIG. 4. To further alleviate the negative pressure, the entire vacuum panel 20, 22 and portions 58 of the panel wall 19 adjacent the vacuum panels, move radially inwardly (56", 58') as shown in dashed lines in FIG. 4. The vertical ribs 52 act as hinges which allow this further movement of the panel wall and vacuum panels, without undue distortion of the container. As described later and shown in FIG. 9, this final concave position 56" of the vacuum panel provides an alternative means of gripping the container.

The rectangular vacuum panel in the embodiment of FIG. 4 is 105 mm in height and 47.7 mm in width. A majority of this area (see FIG. 7) is available for inversion, other than the stepped shoulder. In this embodiment, the vertical ribs 52 are disposed a circumferential distance of about 10 mm from the side edges of the vacuum panel 20, 22.

Figure 5:
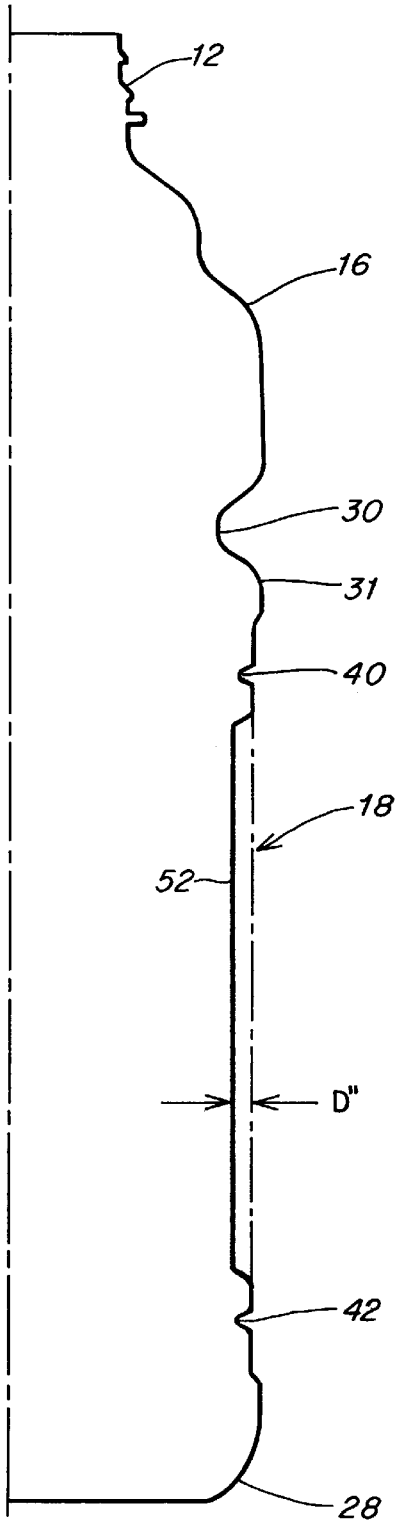
FIG. 5 is a longitudinal sectional view of the container of FIG. 1 taken along line 5—5 of FIG. 4, showing a vertical rib which is radially indented from the panel diameter (dashed line).

FIG. 5 illustrates a longitudinal sectional view of one half of the container, showing the container profile in cross-section with one of the four vertical ribs 52. The rib 52 is recessed from the panel diameter D, by a depth D", as previously described.

Figure 6:
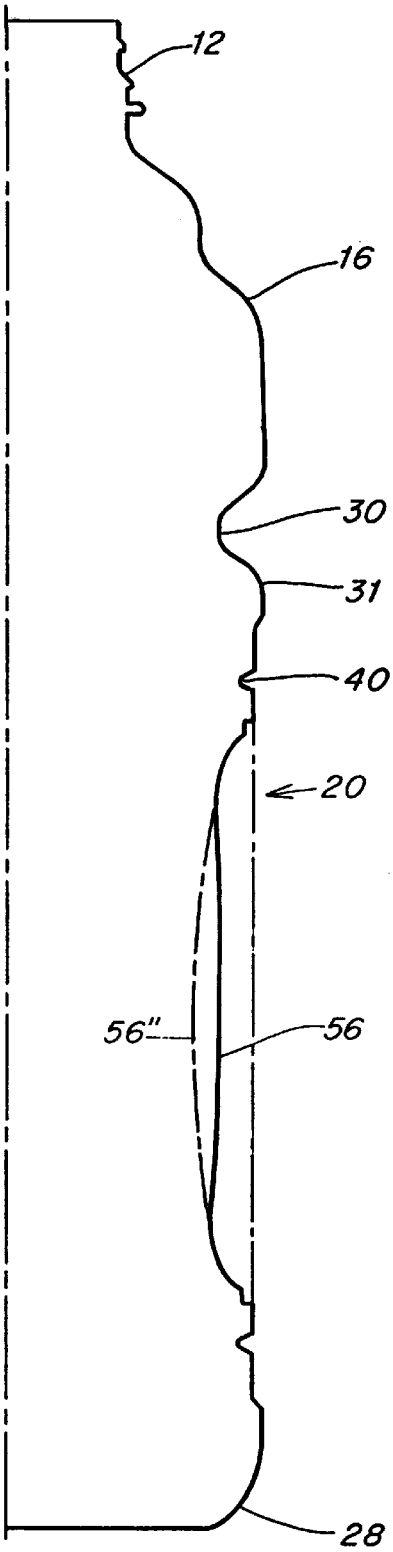
FIG. 6 is a longitudinal sectional view of the container of FIG. 1 taken along line 6—6 of FIG. 4, showing a vacuum panel as molded which is radially indented from the panel diameter (outer dashed line), but having a convex central wall portion.

FIG. 6 shows another longitudinal sectional view through one of the vacuum panels 20. It illustrates in solid lines the original convex profile of the central wall portion 56, and the final concave profile 56" in dashed lines after filling and cooling. As previously described, this ability to invert the central wall portion of the vacuum panels increases the amount of negative pressure which can be alleviated in the container, while utilizing only two vacuum panels. In addition, the inversion is reversible and once the container is opened by the customer, the vacuum panel wall portion 56 will revert to a convex profile. This may serve as a safety feature to notify the consumer that the container has not been opened since it was hot-filled and sealed by the beverage supplier.

Figure 7:
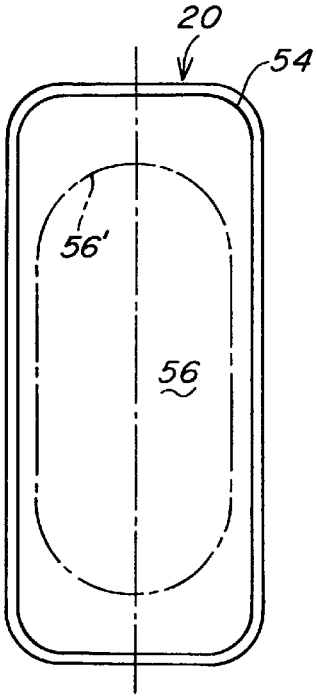
FIG. 7 is a side elevational view of a vacuum panel, showing the invertible central wall portion.

FIG. 7 shows a front view of the invertible central wall portion 56 of the vacuum panel container 20 of FIG. 6. In this example, a large percentage (i.e., 60%) of the central wall portion has inverted.

Figure 8:
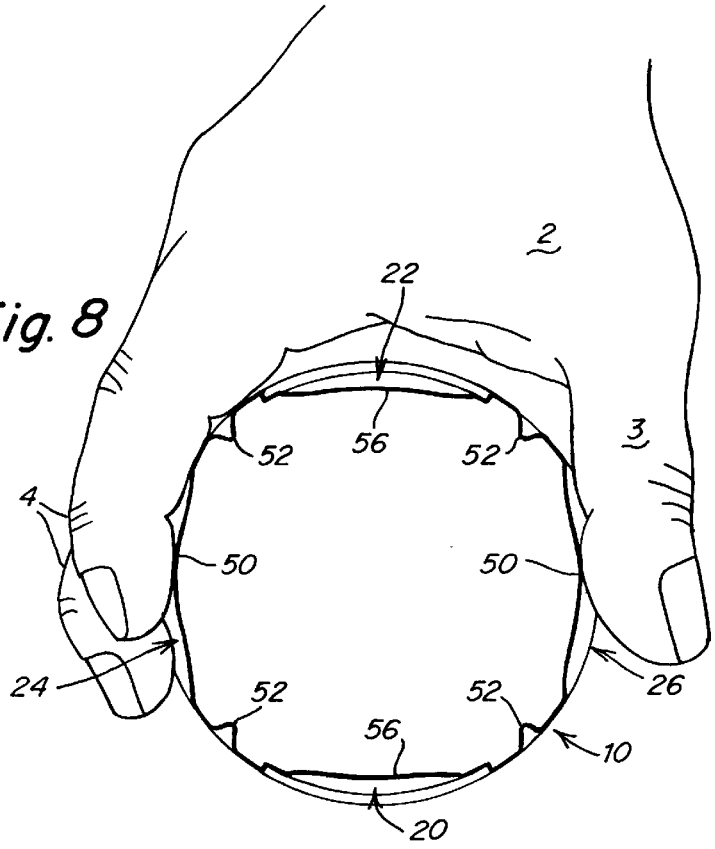
FIG. 8 is a cross-sectional view of the container showing a user holding the container at the opposing finger grip portions.

FIG. 8 is a schematic cross-sectional view showing one of two mechanisms for gripping the container. In FIG. 8, a human hand 2 is shown with a thumb 3 engaging one hand grip channel 50 on a first side of the container, and the four fingers 4 placed in each of the four channels 50 on the opposite side of the container. These channels have not been deformed in spite of the temperature/pressure conditions generated by the hot-filling and cooling process.

Figure 9:
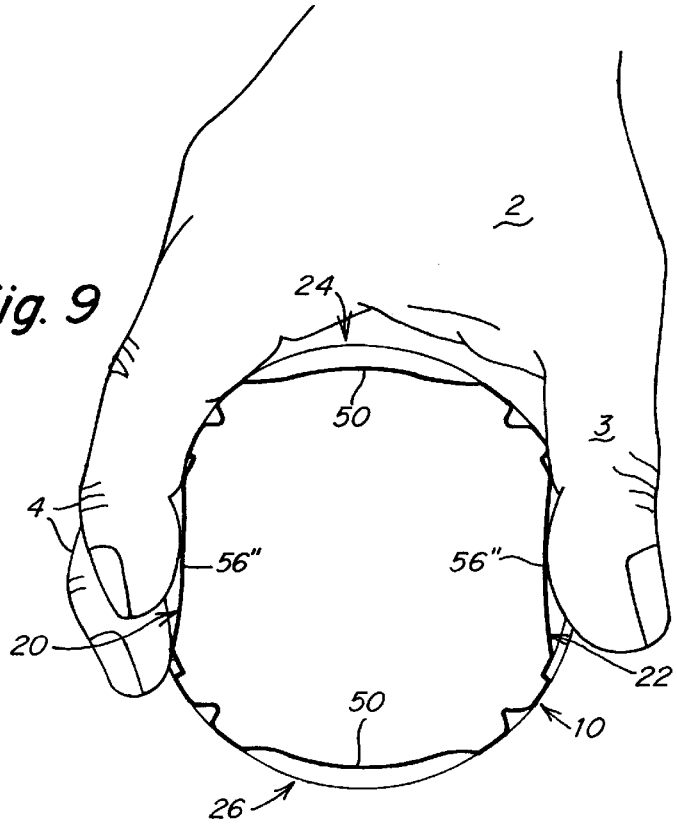
FIG. 9 is a cross-sectional view of the container showing a user holding the container at the opposing vacuum panels.

FIG. 9 shows an alternative mechanism for holding the container in one hand. In FIG. 9, the user's thumb 3 is placed in one convex vacuum panel portion 56", while the opposing fingers 4 are placed in the other convex vacuum panel portion 56". This provides an alternative mechanism for holding the container in one hand, and a smaller grip scan (e.g., for a smaller hand).

The container may be made of any of the known polymer resins which provide good strength at elevated fill temperatures, such as polyesters, polyolefins, polycarbonates, nitrites, and copolymers of the above, as well as other high-temperature polymers.

Phthalic acid polyesters based on terephthalic or isophthalic acid are commercially available and convenient. The hydroxy compounds are typically ethylene glycol and 1,4-di-(hydroxymethyl)-cyclohexane. The intrinsic viscosity for phthalate polyesters is typically in the range of 0.6 to 1.2, and more particularly 0.7 to 1.0 (for O-chlorolphenol solvent). 0.6 corresponds approximately to a viscosity average molecular weight of 59,000 and 1.2 to a viscosity average molecular weight of 112,000. In general, the phthalate polyester may include polymer linkages, side chains, and end groups not related to the formal precursors of a simple phthalate polyester. Conveniently, at least 90 mole percent will be terephthalic acid and at least 45 mole percent an aliphatic glycol or glycols, especially ethylene glycol.

Another useful polymer, with physical properties similar to PET, is polyethylene naphthalate (PEN). PEN provides higher thermal resistance and a 3–5× improvement in oxygen barrier property (over PET), at some additional expense.

The container may be either a monolayer, or a multilayer construction, including layers of an oxygen barrier material such as ethylene vinyl alcohol or polyvinyledene chloride, and may include a layer of reprocessed scrap material, such as post-consumer or recycled PET.

The container may have a closure other than a screw threaded cap, such as a slidable nozzle as used on sports bottles.

In this embodiment, a wrap-around or partial label may be applied to the shoulder portion 16; alternatively a shrink-wrap label may be applied around the panel section (which adopts the shape of the finger grips and vacuum panels).

Preferably the angular extent of each of the two vacuum panels is 50 to 90°, and each finger grip 50–90°. The angular extent between the vacuum panel and finger grip is preferably 18 to 30°. The height of each vacuum panel is preferably at least 1.5 times the width of the vacuum panel.

The two vacuum panels are preferably symmetrically disposed about the panel circumference, i.e., their vertical center lines are 180° apart. However, there may be applications where they are somewhat offset, e.g., 150–180°.

The container of the present invention may alternatively be described as a hot-fillable plastic container, having alternate panel sections and reinforcing sections, wherein the panel sections have an invertible central wall portion, movable from a convex first position prior to hot-filling of the container, to a concave section position under vacuum pressure following hot-filling and sealing of the container. The reinforcing sections have two or more horizontal, radially-indented channels. The channels provide resistance to bending of the panel in the hoop direction. Preferably, the radially-indented channels are of a sufficient size and shape to also act as finger grips.

Although certain preferred embodiments of the invention have been specifically illustrated and described herein, it is to be understood that variations may be made without departing from the spirit and scope of the invention as defined by the appended claims. For example, container sizes and shapes may be varied as well as the vacuum panel design. Thus, all variations are to be considered as part of the invention as defined by the following claims.

We claim:

1. A hot-fillable plastic container having a panel section configured to be gripped in one hand, the panel section including two opposing and vertically-elongated and radially-indented vacuum panels, two opposing horizontally-disposed and radially-indented finger grips, each vacuum panel having an invertible central wall portion movable from a convex first position prior to hot-filling of the container to a concave second position under vacuum pressure following hot-filling and sealing of the container.

2. The container of claim 1, wherein the panel section includes a pair of vertically-elongated and radially-indented ribs adjacent either side of each vacuum panel which act as hinge points to facilitate movement of the central wall portions.

3. The container of claim 1, wherein the vacuum panels are symmetrically disposed in the panel section.

4. The container of claim 1, wherein the panel section has a diameter of no greater than 4.5 inches.

5. The container of claim 4, wherein the panel section has a diameter in the range of 2.5 to 4.5 inches.

6. The container of claim 1, wherein the opposing finger grips include two sets of four finger grips in each set.

7. The container of claim 1, wherein the finger grips have an angular extent of from 50–90°.

8. The container of claim 1, wherein the vacuum panels have an angular extent of from 50–90°.

9. The container of claim 1, wherein an angular distance between the vacuum panels and finger grips is from 18–30°.

10. A hot-fillable plastic container having a panel section configured to be gripped in one hand, the panel section including two opposing horizontally-disposed and radially-indented finger grips which as first gripping members, and two opposing vertically-elongated and radially-indented vacuum panels which act as alternative second gripping members.

11. A hot-fillable plastic container, having alternate vacuum panel sections and reinforcing sections, wherein the vacuum panel sections have an invertible central wall portion, movable from a convex first position prior to hot-filling of the container, to a concave second position under vacuum pressure following hot-filling and sealing of the container, and wherein the reinforcing sections have finger grips comprising two or more horizontal radially-indented channels of a width adapted to receive a finger or thumb and the reinforcing sections have vertical ribs between the vacuum panels and finger grips which vertical ribs facilitate movement of the vacuum panels while isolating the vacuum panel movements from the finger grips.

12. The container of claim 11, wherein the the container has a diameter of no greater than 4.5 inches and the vacuum panels are symmetrical about the container diameter.

13. A hot-fillable plastic container having a panel section configured to be gripped in one hand, the panel section including two opposing vertically-elongated and radially-indented vacuum panels and two opposing sets of horizontally-disposed and radially-indented finger grips, the panel section including a vertical rib between each vacuum panel and set of finger grips, the vertical ribs facilitating movement of the vacuum panels while isolating such movement from the finger grips, the vacuum panels being symmetrically disposed in the panel section, and the panel section having a diameter of from 2.5 to 4.5 inches, the vacuum panel having an angular extent of from 50–90°, each set of finger grips having an angular extent of from 50–90°, and the angular extent between each vacuum panel and set of finger grips being from 18–30°.

14. The container of claim 13, wherein each vacuum panel has an invertible central wall portion moving from a convex first position prior to hot filling of the container, to a concave second position under vacuum pressure following hot filling and sealing of the container.

* * * * *